US005129748A

United States Patent [19]

Brandon et al.

[11] Patent Number: 5,129,748

[45] Date of Patent: Jul. 14, 1992

[54] COMPACT PRINTER HAVING SHEET AND TRACTOR MEDIA SELECTIONS

[75] Inventors: John M. Brandon; Brian D. Bradley, both of Beavercreek; Richard J. Ratermann, Centerville, all of Ohio

[73] Assignee: Eastman Kodak Company, Rochester, N.Y.

[21] Appl. No.: 435,108

[22] Filed: Nov. 13, 1989

[51] Int. Cl.[5] ..... B41J 13/20

[52] U.S. Cl. ..... 400/605; 400/616; 400/639.1

[58] Field of Search ..... 400/616, 616.1, 624, 400/605, 639.1, 639.2

[56] References Cited

U.S. PATENT DOCUMENTS

| | | | |
|---|---|---|---|
| 3,746,142 | 7/1973 | Hepp et al. | 400/618 |
| 3,880,016 | 4/1975 | Jamieson et al. | 400/616.1 |
| 4,452,543 | 6/1984 | Adkisson et al. | 400/605 |
| 4,655,626 | 4/1987 | Okazaki | 400/616.1 |
| 4,688,957 | 8/1987 | Prevignano | 400/616 |
| 4,725,857 | 2/1988 | Piatt et al. | 346/134 |
| 4,728,966 | 3/1988 | Piatt et al. | 400/82 |
| 4,918,463 | 4/1990 | Piatt | 400/660.3 |

FOREIGN PATENT DOCUMENTS

| | | | |
|---|---|---|---|
| 0097871 | 5/1987 | Japan | 400/616 |

*Primary Examiner*—Edgar S. Burr
*Assistant Examiner*—John S. Hilten
*Attorney, Agent, or Firm*—John D. Husser

[57] ABSTRACT

A sheet or tractor media handling system for a compact printer having a housing, a cut-sheet supply station and a rotatable print platen constructed and located to feed top sheets from said supply station through a print path ingress past a print zone and out a print path egress. The system includes a mode control assembly for selectively controlling the movement of said supply station for sheet or tractor media; a pair of guide wheels constructed and mounted for engagement with tractor media along a tractor media inlet passage; bail rollers engaging the platen between the print path ingress and egress; and a variable spring system for urging the bail rollers against the print platen with higher or lower nip pressures for sheet or tractor media conditions.

5 Claims, 3 Drawing Sheets

COMPACT PRINTER HAVING SHEET AND TRACTOR MEDIA SELECTIONS

FIELD OF THE INVENTION

The present invention relates to compact printers capable of printing with either continuous, edge perforated print media (commonly referred to as tractor media) or sheet media and, more specifically to an improved media feeding and guiding system for enabling the printer to operate selectively in either of such sheet or tractor media modes.

BACKGROUND OF INVENTION

U.S. Pat. No. 4,725,857 discloses a compact printer having a unique integral sheet feeding system that is interchangably operative with a continuous, edge perforated tractor media feeding system. Both feeding systems share a feeder-platen member which moves the media from a region near the bottom of the printer housing through the print zone and out through the top of the housing. Sheet feed is effected by providing cyclic feed contacts between the top sheet of a supply station stack and a friction surface(s) on the feeder-platen. To switch to the tractor media mode, a control lever is moved to disengage the sheet supply from the feeder-platen and to open the passage for tractor media to be fed above the sheet media stack, into the printing region, where it can be positioned on pins on the ends of the feeder-platen that cooperate with the perforations of the tractor media.

In certain printer embodiments, the provision of the tractor media pins on the feeder-platen presents difficulties. For example, when using a plurality of different color print heads that each traverse entire line portions of the print media; the protruding pins on the feeder-platen can block the passage of "end" print heads, which is necessary to allow "central" print heads to cover the full scan line distance. This problem can be solved by retractable pins or pivoting print heads, but those solutions are not desirable because of their mechanical complexities.

SUMMARY OF INVENTION

One important object of the present invention is to provide for a compact printer having an integral sheet feeding system, a cooperative system for guiding and feeding tractor media that avoids the problems noted above. Thus, one advantage of the present invention is that its tractor media engagement structures do not impede print head traverse. A further advantage of the present invention is that, in systems according to the present invention, the tractor engagement structures can be readily adjusted for varying paper widths. Another advantage of the present invention is that its construction allows a common feeder-platen drive for both sheet and tractor media, but allows tractor media feed control structures to override the feeder-platen drive, when necessary.

In one preferred embodiment the present invention constitutes an improved print media handling system for a compact printer of the kind having a housing, a cut-sheet supply station formed in the lower portion of the housing and a rotatable print platen constructed and located to feed top sheets from the supply station through a print path ingress, past a print zone and out a print path egress formed in the upper portion of the housing. Such media handling system includes a supply station mounted for movement to and from a sheet engaging relation with respect to the print platen; a device for selectively controlling such movement of the supply station; a tractor media inlet passage into the housing, under the platen and to the print path ingress; a pair of feed control wheels constructed and mounted for unitary rotation in engagement with tractor media along the media inlet passage; bail rollers engaging the platen between the print path ingress and egress; a spring system for urging the bail rollers to drive relations with the platen; and a spring control device for varying the urging force between different sheet and tractor media conditions.

DETAILED DESCRIPTION OF PREFERRED EMBODIMENTS

Figure 1:
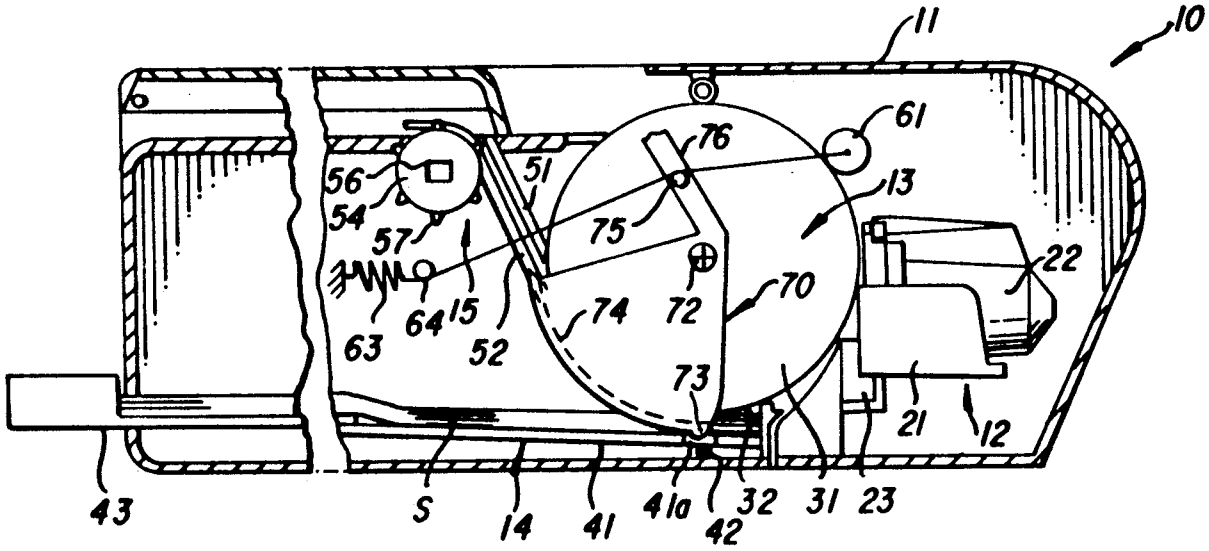
FIGS. 1 and 2 are cross sectional side views respectively showing different operational media of one preferred compact printer embodiment in accord with the present invention.
Figure 2:
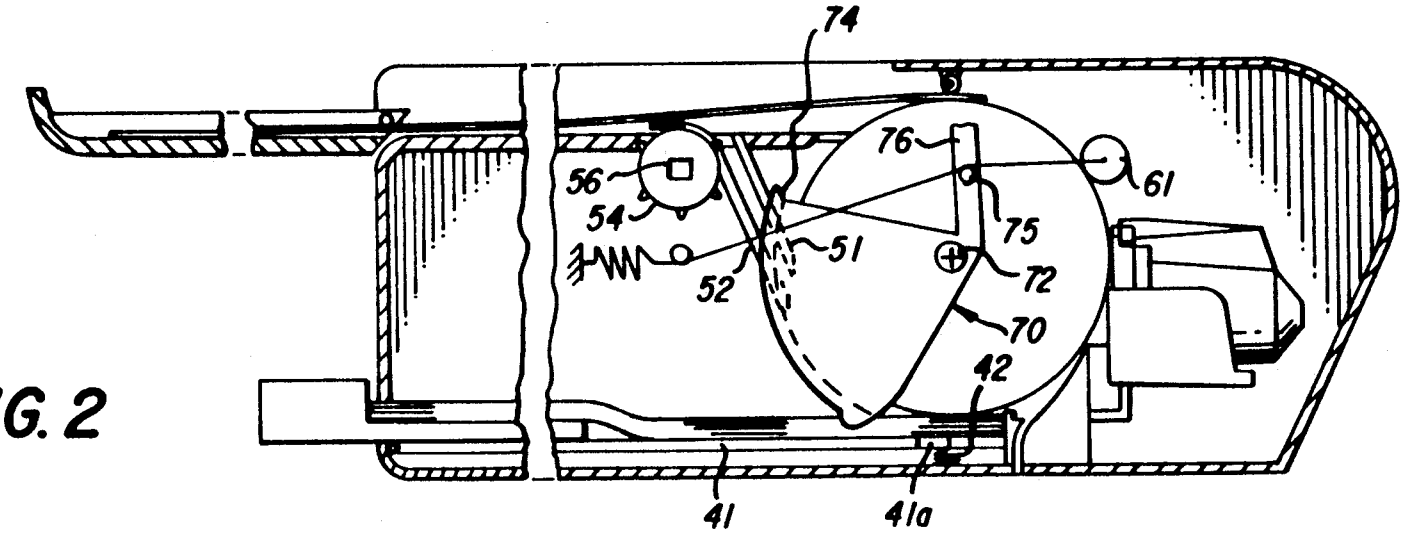

One preferred embodiment of compact printer 10, constructed in accord with the present invention, is shown in FIGS. 1 and 2 respectively in its tractor media and sheet media orientations. In general the printer comprises a housing 11 which substantially encloses a print head carriage assembly 12, a feeder-platen assembly 13, a sheet media supply station assembly 14 and a tractor media feed control assembly 15.

The print head carriage assembly 12 can be of the kind described in U.S. Pat. No. 4,709,245 and comprise a plurality of nests 21 adapted to receive and operatively position print/cartridges 22. The carriage assembly includes drive means (not shown) for traversing the nests 21 along support rail 23 to print successive line portions of print media moved through a print zone by the feeder-platen assembly 13.

The feeder platen assembly comprises a feeder-platen 31 rotatably mounted so that its periphery passes a media supply region, the print zone and a media egress region. It preferably has frictional surface portions 32 for feeding sheets from the printer supply as described in U.S. Pat. No. 4,763,138.

The sheet media supply station assembly 14 comprises a force plate element 41 movably mounted in the bottom of the printer and urged toward the feeding-platen 31 by a force plate spring 42. A drawer 43 in the rear of the printer can be provided to load a sheet stack S onto the force plate as described in U.S. Pat. No. 4,783,669.

The tractor media feed control assembly 15 comprises two subassemblies. Thus, a pair of guide members 51, 52 extend from the top of the printer, down to a location above a supported sheet stack so that the lead end of the tractor media can be inserted beneath the feeder platen 31 and up through the print zone to a position for commencement of print operation. The second subassembly comprises a pair of feed control wheels 54, that are keyed to a shaft 56. The shaft has end extensions (not shown) mounted in the housing 11 so that the shaft and its keyed wheels can rotate as an integral unit. Each guide wheel has a plurality of tracking pins 57 spaced around its periphery with a pitch that matches the perforations pitch in tractor media. In one embodiment, slotted cover members 58 can be supported in the printer to pivot on hinges 59 and hold tractor media on the pins of wheels 54. The wheels and the cover members can be slidable along the direction of the length of shaft 56 to accommodate different widths of media. The shaft 56 is mounted in the printer in a manner providing a frictional drag to its rotation, but is otherwise non-driven, or in an idler mode. Thus, as tractor media is advanced by feeder-platen 31, the engagements of pins 57 with the pulled media rotate the wheel-shaft unit integrally so that the wheels maintain a lateral guiding of the media with respect to its feed path.

In accord with the present invention, a bail roller assembly cooperates with the structures just described and a movable mode control member 70 to provide a higher nip pressure between the bail roller and the feeder-platen in sheet feed mode and a lower nip pressure in the tractor media mode. This is desirably because the sheet feed mode relies on non-slippage at the nip to maintain lateral tracking of a sheet, while the tractor media mode relies on the drag forces of guide wheels 54 to maintain tracking, and thus needs a slippable condition at the bail roller nip to allow the guide wheels to dominate.

To achieve the dual nip pressure bail rollers 61 are mounted for movement toward and away from the feeder platen (in a conventional fashion) but are urged toward the feeder-platen by a spring assembly comprising cables 62 and springs 63, coupled to housing 11. As shown in FIGS. 1 and 2, the cables extends over a path defined by fixed constraint members 64 and constraint member 75 which is mounted on, and movable with, mode control members 70.

Figure 3:
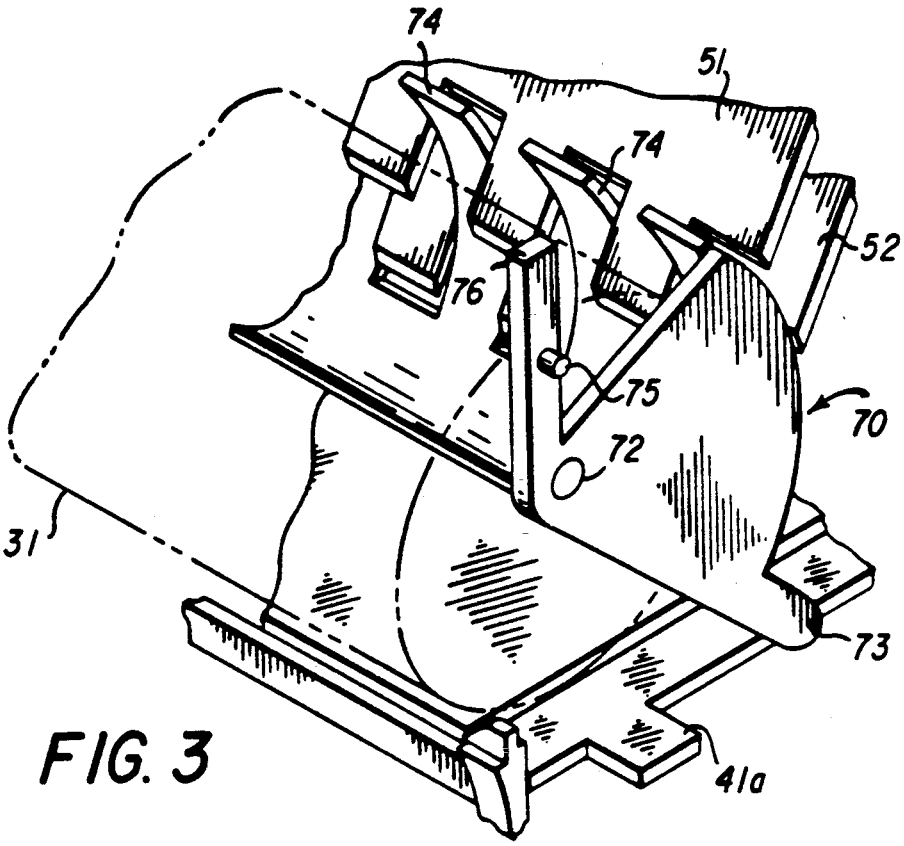
FIG. 3 is a fragmentary perspective view showing enlarged portions of the FIG. 1 printer.
Figure 4:
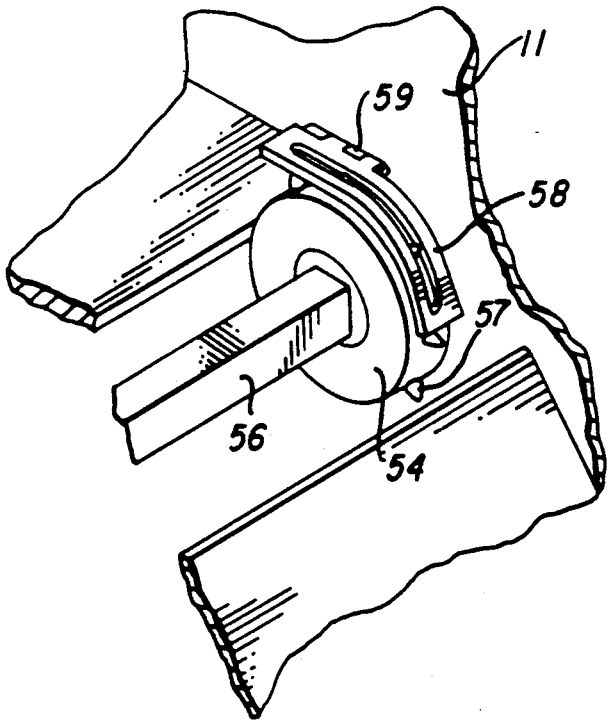
FIG. 4 is another fragmentary perspective view showing enlarged portions of the FIG. 1 printer.

Structures and functions of such mode control member 70, other than those of constraint member 75, are described in detail in U.S. Pat. No. 4,725,857. As shown in FIG. 3, this member is mounted in the printer housing for rotation on mount pin 72 and includes a cam member 73, guide teeth portions 74 and operating lever 76 on which constraint member 75 is formed. As described in the '857 patent, rotation of the mode control member 70 to the FIG. 1 position causes the cam surface 73 to engage tab 41*a* of force plate 41 and depress the sheet stack S. This rotation also moves teeth guides 74 in a position for directing tractor media between the stack S and feeder platen 31. Movement of the mode control lever to the FIG. 2 position allows force plate 41 to move up so sheets thereon can be engaged by the feeder platen and moves teeth 74 to block the tractor media ingress.

In accord with the present invention the movement of the mode control member 70 between the FIG. 1 and FIG. 2 conditions also adjusts the nip pressure of bail roller 61 to that appropriate for tractor media or sheet media operation. Thus in the FIG. 1, tractor media, printer mode the constraint provides a relatively shorter cable path from bail rollers 61 to springs 64. This provides a relatively lower nip pressure at the bail roller to allow tractor media to be loaded and fed under control of the guide wheels 54. In the FIG 2, sheet media, printer mode the constraint member 75 lengthens the cable path from bail rollers 61 to springs 63 and provides a relatively higher nip pressure for sheet and print operations.

Figure 5:
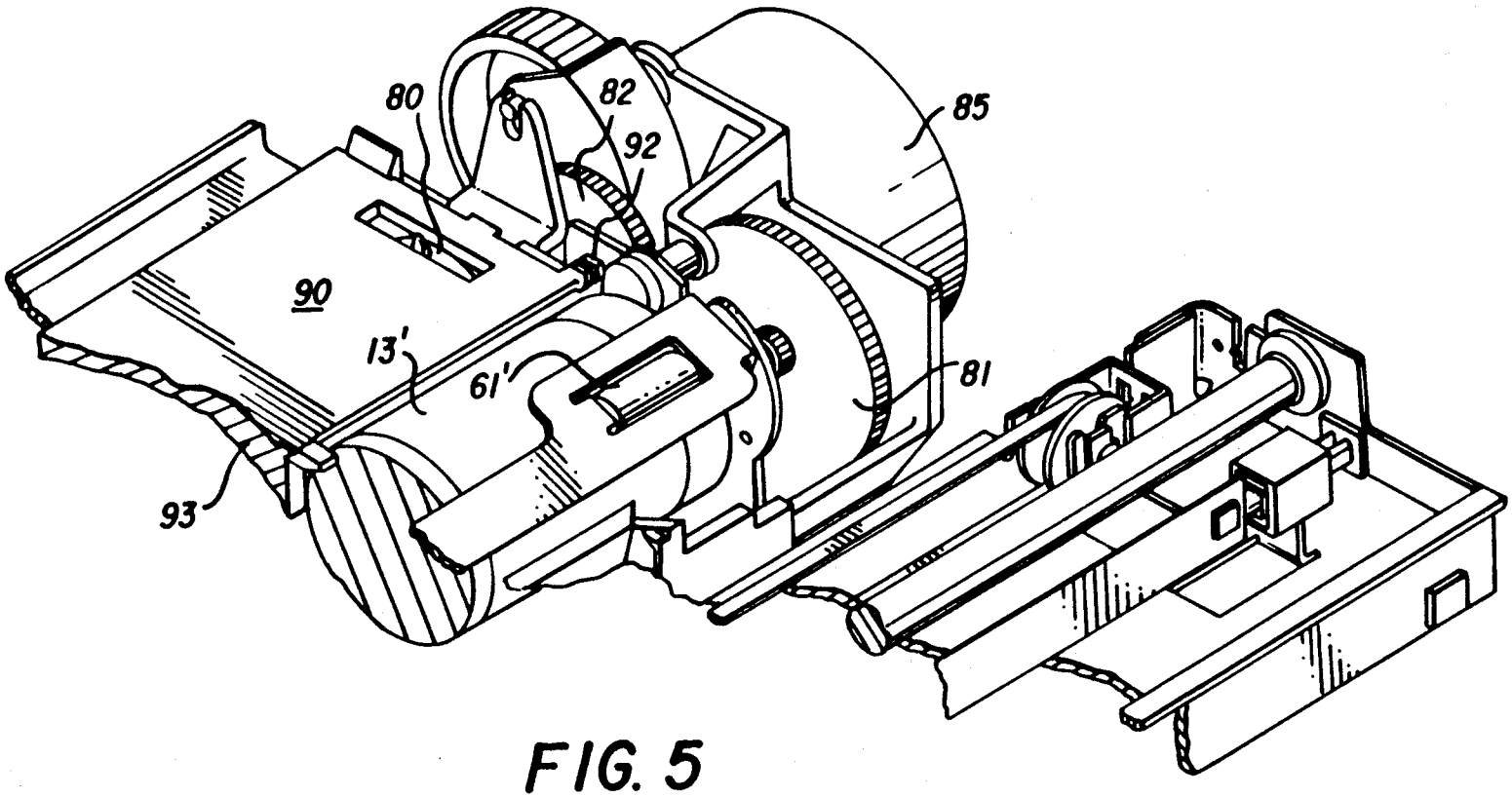
FIG. 5 is a fragmentary perspective view showing an alternative preferred embodiment for tractor media feed control in accord with the present invention.

FIG. 5 shows an alternative preferred embodiment of the present invention wherein the feed control wheels 80 are driven with a slightly lower peripheral speed than the platen 13'. Thus, rather than idling with a friction drag as in the previous embodiment, wheels 80 are driven through gear train 81, 82 (coupled to motor drive 85). By such construction the feed control system comprising wheels 80 and their drive perform similarly to the previously described embodiments, providing controlled drag on media feed at the nip of bail rollers 61' and feed-platen 13'. The same spring assembly as described previously is provided to control the pressure at the bail roller nip so that tractor media can slip and allow guide wheels 80 to effect feed control. Also, in the FIG. 5 embodiment, a single plate 90, hinged at mountings 92, is pivotable to allow tractor paper to be inserted and then closed as shown in FIG. 5 to retain the engagement of media perforations on pins of wheels 80. The under surface of plate 90 has guide members 93 which perform like elements 51 in the previous embodiments.

The invention has been described in detail with particular reference to certain preferred embodiments thereof, but it will be understood that variations and modifications can be effected within the spirit and scope of the invention.

We claim:

1. In a printer having a housing, a cut-sheet supply station and a rotatable print platen constructed and located to feed sheets from said supply station through a print path ingress, past a print zone and out a print path egress, a print media handling system comprising:

(a) mode control means for selectively controlling said supply station to enable sheet or tractor media operation;

(b) means forming a tractor media inlet passage under said platen and to said print path ingress;

(c) a pair of tractor feed control wheels constructed and mounted along said inlet passage for unitary rotation and engagement with tractor media to impart a frictional drag to the feed of tractor media;

(d) bail roller means engaging said platen between said print path ingress and egress;

(e) spring means for urging said bail roller means to two different non-zero media driving force engagements with said platen; and (f) spring control means responsive to said mode control means for varying said driving force engagements between said bail roller means and said platen respectively during sheet and tractor media drive conditions including means for the force exerted by said spring means.

2. In a compact printer having a housing, a cut-sheet supply station formed in the lower portion of said housing and a rotatable print platen constructed and located to feed top sheets from said supply station, through a print path ingress, past a print zone and out a print path egress formed in the upper portions of said housing, a print media handling system which is adjustable between sheet feed and tractor feed modes and which comprises:

(a) means mounting said supply station for movement to and from a sheet engaging positions with respect to said print platen;

(b) mode control means for selectively controlling the movement of said supply station between said positions;

(c) means forming a tractor media inlet passage into said housing, under said platen and to said print path ingress;

(d) a pair of feed control wheels constructed and mounted for unitary rotation and engagement with tractor media along said inlet passage to impart a frictional drag thereto;

(e) bail roller means engaging said platen between said print path ingress and egress;

(f) spring means for urging said bail roller means into higher and lower non-zero nip pressures with said platen; and (g) spring control means responsive to said mode control means for varying a force exerted by said spring means to effect said higher non-zero nip pressure in the sheet feed mode and said lower non-zero nip pressure in the tractor media feed mode.

3. The invention defined in claim 2 wherein said spring control means is coupled to said mode control means for synchronous operation therewith.

4. The invention defined in claim 3 wherein said spring control means effects a decrease in said force in response to movement of said sheet supply station to said sheet engaging position.

5. The invention defined in claim 3 further including means, responsive to said mode control means for selectively blocking and unblocking said tractor media inlet passage.

* * * * *